US005711742A

United States Patent [19]

Leinonen et al.

[11] Patent Number: 5,711,742

[45] Date of Patent: Jan. 27, 1998

[54] MULTI-SPEED MARINE PROPULSION SYSTEM WITH AUTOMATIC SHIFTING MECHANISM

[75] Inventors: Brian M. Leinonen, Perkins; Philip T. Scott; Robert F. Novotny, both of Stillwater, all of Okla.

[73] Assignee: Brunswick Corporation, Lake Forest, Ill.

[21] Appl. No.: 494,605

[22] Filed: Jun. 23, 1995

[51] Int. Cl.[6] ..... F16H 59/30; B63H 23/02

[52] U.S. Cl. ..... 477/121; 440/75

[58] Field of Search ..... 440/75, 76; 477/121; 74/335

[56] References Cited

U.S. PATENT DOCUMENTS

| | | | |
|---|---|---|---|
| 4,428,734 | 1/1984 | Ludlow | 440/75 X |
| 4,817,466 | 4/1989 | Kawamura et al. | 440/75 X |
| 4,820,209 | 4/1989 | Newman | 440/75 X |
| 4,850,911 | 7/1989 | Nakahama et al. | 440/75 X |
| 4,887,983 | 12/1989 | Bankstahl et al. | 440/75 X |
| 4,932,907 | 6/1990 | Newman et al. | 440/75 X |
| 5,009,621 | 4/1991 | Bankstahl et al. | 440/75 |
| 5,018,996 | 5/1991 | Newman et al. | 440/75 |
| 5,123,940 | 6/1992 | Haubner | 477/121 X |
| 5,230,644 | 7/1993 | Meisenburg et al. | 440/80 |
| 5,344,349 | 9/1994 | Meisenburg et al. | 440/80 |
| 5,419,412 | 5/1995 | Schwab et al. | 74/335 X |
| 5,425,663 | 6/1995 | Meisenburg et al. | 440/76 X |

OTHER PUBLICATIONS

Pp. 12 and 13 from B&M Marine Catalog.

*Primary Examiner*—Khoi Q. Ta

*Attorney, Agent, or Firm*—Andrus, Sceales, Starke & Sawall

[57] ABSTRACT

A marine propulsion system, preferably having dual counterrotating propellers, has an automatic multi-speed shifting mechanism such as a transmission. An electronic controller monitors engine parameters such as engine revolution speed and load, and generates a control signal in response thereto, which is used to control shifting. Engine load is preferably monitored by sensing engine manifold air pressure. The electronic controller preferably has a shift parameter matrix stored within a programmable memory for comparing engine speed and engine load data to generate the control signal. The system can also have a manual override switch to override shifting of the shifting mechanism.

16 Claims, 1 Drawing Sheet

MULTI-SPEED MARINE PROPULSION SYSTEM WITH AUTOMATIC SHIFTING MECHANISM

BACKGROUND AND SUMMARY OF THE INVENTION

The invention arose during development efforts directed towards improving the overall performance of marine drives. The invention is a multi-speed marine propulsion system having an automatic shifting mechanism.

In conventional single speed marine drives, an engine is mechanically connected directly to the propeller through a gear box, and the speed of the propeller is, generally speaking, proportional to the speed of the engine. Such a drive uses a fixed-blade propeller, and is normally designed for optimum performance over a desired range. For instance, drive systems designed for maximum speed sacrifice low speed acceleration, and likewise, drive systems designed for maximum low speed acceleration sacrifice top speed performance.

A multi-speed transmission can be employed to alleviate this problem with single speed marine drive systems. A multi-speed transmission with a low gear (e.g. 1.33:1) improves acceleration at low speeds, while maintaining maximum top speed by shifting to a high gear (e.g. 1.0:1). Propeller cavitation can, however, result in low gear because of increased torque to the propeller.

The invention provides a marine propulsion system with an automatic multi-speed shifting mechanism, preferably an automatic multi-speed transmission. Propeller cavitation problems can be alleviated with the invention by using dual counterrotating propellers because dual propellers provide sufficient surface area to prevent cavitation even at high power outputs. If a single propeller is used, propeller cavitation problems be can alleviated by limiting power output.

The preferred automatic transmission has at least a high gear and a low gear, and is controlled using a programmable electronic controller. The electronic controller monitors engine load and revolution rate, and generates a control signal that controls the shifting of the transmission. A manual override switch can also be provided to manually override shifting of the transmission. The electronic controller preferably has a shift parameter matrix stored in memory for comparing engine revolution rate and engine load data to generate the control signal.

DETAILED DESCRIPTION OF THE PREFERRED EMBODIMENT

Figure 1:
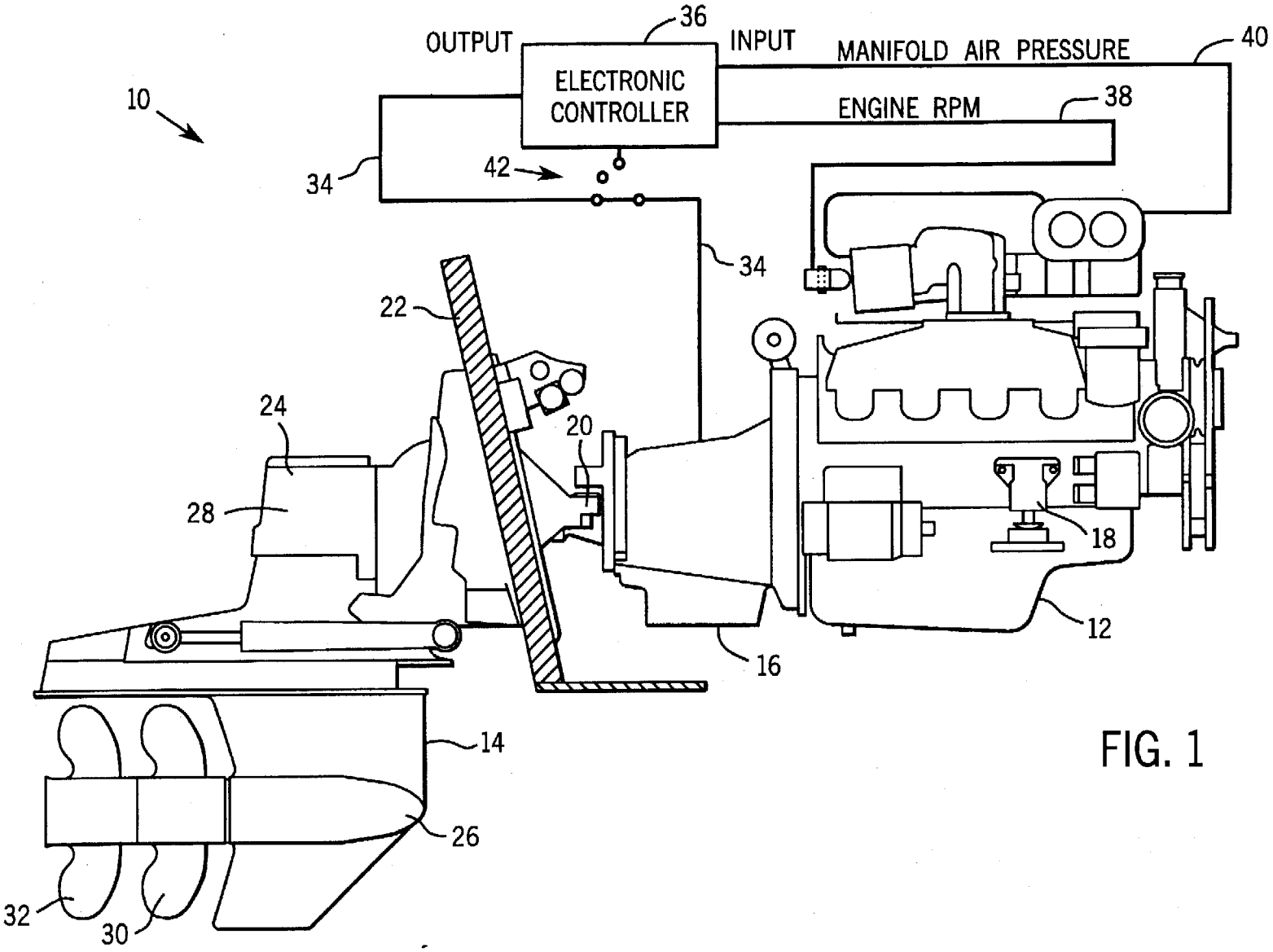
FIG. 1 is a schematic drawing showing a multi-speed marine propulsion system with an automatic shifting mechanism in accordance with the invention.

FIG. 1 shows a multi-speed marine propulsion system 10 having an engine 12, a drive unit 14 and an automatic transmission 16 which is the preferred embodiment of the invention. The propulsion system 10 shown in FIG. 1 is an inboard/outboard or stem drive system.

The engine 12 is located within a boat. Engine mounts 18 attach the engine 12 to the boat. The engine 12 can be a gas engine such as a General Motors 5.7 liter V-8, or a diesel engine such as a VM 4.2 liter. The engine 12 provides power through a crankshaft rotating at an engine revolution rate.

The preferred shifting mechanism is an automatic transmission 16, preferably a two-speed transmission, although other types of shifting mechanisms can be used within the spirit of the invention. The automatic transmission 16 receives power from the engine crankshaft, through some type of torsional dampening device, and outputs power to an input shaft 20 of the drive unit 14. The input shaft 20 either extends through or is coupled through a transom 22 of the boat. A gear case 24 is mounted to the exterior of the transom 22. The gear case 24 pivots horizontally and vertically to accommodate a universal joint connected to the input shaft 20. Gears and driveshafts within the gear case 24 transmit the power from the input shaft 20 to concentric, counterrotating propeller shafts located in a torpedo housing 26 of the gear case 24. Within the torpedo 26, the gear case 24 has fore and aft gears to contemporaneously drive the counterrotating propeller shafts. The counterrotating propeller shafts transmit the power in the driveshaft to counterrotating propellers 30 and 32. The counterrotating propellers 30 and 32 propel the boat. The propellers 30 and 32 are oppositely pitched so that rotation of each propeller provides forward thrust to the boat. U.S. Pat. Nos. 5,230,644; 5,009,621; 5,344,349; 4,932,907; and 4,887,983 relate to marine drives with dual counterrotating propellers and are incorporated herein by reference. Dual counterrotating propellers 30 and 32 are preferred, but the invention also contemplates the use of a single propeller to propel the boat. The gearing within the gear case 24 is normally in the range of 1.36:1 to 2.2:1, which means that each propeller makes proportionally fewer revolutions than the input shaft 20 during a given time period. A shifting clutch assembly located within an upper portion 28 of the gear case 24 causes the driveshaft within the gear case 24 to rotate in a forward direction, reverse direction, or remain in neutral as is disclosed in the noted incorporated patents. Alternatively, a shifting clutch assembly can be located within the automatic transmission 16 or some other automatic shifting mechanism.

If the engine 12 is a gasoline engine, the preferred gear ratio for the high gear in the transmission 16 is 1:1, and the preferred gear ratio for the low gear is 4:3. The low gear provides improved acceleration at low speeds. This improves racing performance, but also can allow underpowered boats to get on plane quicker and allow water skiers to get up quicker. Acceleration is improved at low speeds using the low gear because the engine 12 revolution rate is allowed to climb faster into regions where the engine 12 will be able to achieve optimum performance. The low gear in the transmission 16 can also be useful for low speed operations such as trolling or docking. The low gear allows for slower idle speeds and also allows better boat control for docking maneuvers and better control of trolling speeds which may eliminate the need for controlling brake devices or the like.

If the engine 12 is a diesel engine, the preferred gear ratio for the low gear in the transmission is 1:1, and the preferred gear ratio for the high gear is 3:4. The 3:4 high gear for a diesel engine 12 is an overdrive gear, which allows the drive unit 14 to operate in the proper torque and RPM ranges for conventional drive unit 14 designs, thus improving durability.

The automatic transmission 16 receives power from the engine crankshaft via some type of torsional dampening device, and transmits that power to the input shaft 20 of the drive unit 14 through either the high gear or the low gear. The automatic transmission 16 preferably has an electronic shifting mechanism such as a transmission shift solenoid or the like. The electronic shifting mechanism receives a control signal that is transmitted through line 34 from an electronic controller 36. The control signal in line 34 can take many forms, but one form would be a 12 volt signal in line 34 to the transmission shift solenoid to actuate and maintain a shift from one gear to another gear (e.g. low to high gear, or high to low gear). The 12 volt signal is preferably controlled by the electronic controller 36. A manual override switch 42 can also be provided. Activating the manual override switch 42 can hold the transmission 16 in the low or high gear regardless of the control signal from the electronic controller 36.

The electronic controller 36 is preferably a programmable logic controller that monitors one or more engine parameters and generates the control signal in response to the monitoring. In the preferred system 10, the electronic controller 36 receives an RPM signal in line 38 that is proportional to the revolution rate of the engine 12 crankshaft. The electronic controller 36 also preferably receives an engine load signal in line 40 that is proportional to the load on the engine 12. A particularly effective method of monitoring engine load is to monitor the air pressure in the engine manifold using a pressure transducer to measure the intake manifold vacuum. If manifold air pressure is used to monitor engine load, the engine load signal would be a manifold vacuum signal (MVS) that is proportional to the air pressure in the engine manifold. An alternative method of monitoring the engine load is to monitor the position of the throttle using a throttle position sensor. If a throttle position signal is used to monitor engine load, the load signal is proportional to the position of the throttle.

In general, the electronic controller 36 should generate a control signal to shift the transmission 16 to the high gear when both the engine revolution rate and the engine load are relatively high. It is preferred that the shift point engine revolution rate increase as engine load increases. The electronic transmission controller 36 should generate a control signal in line 34 to shift the transmission 16 to low gear for low speed operation, i.e. when both the engine revolution rate and the engine load are relatively low. It is preferred that the shift point to low gear be substantially less than the shift point to high gear. Also, it may be desirable for the electronic controller 36 to generate a control signal in line 34 to shift the transmission 16 to the low gear for quick acceleration when the engine revolution rate is mid-range, but the engine load is high. This is useful for improved mid-range acceleration. In such a mode, it would be preferable for the electronic controller 36 to generate another control signal to shift the transmission 16 to high gear after sufficient acceleration has been accomplished.

In a system 10 having a gasoline engine 12 in which manifold air pressure is used to monitor engine load, the electronic controller 36 can use a control algorithm to generate control signals in response to the RPM signal and the engine load signal. Alternatively, the electronic controller 36 can store in memory a shift parameter matrix such as that shown in Table 1:

Shift Parameter Matrix

1. Shift to high if RPM>2000 and MVS is between 35 and 47
2. Shift to high if RPM>2600 and MVS is between 48 and 60
3. Shift to high if RPM>3200 and MVS is between 61 and 73
4. Shift to high if RPM>3900 and MVS is between 74 and 86
5. Shift to high if RPM>4600 and MVS is between 87 and 99
6. Shift to low if RPM<1800 and MVS is between 1 and 34
7. Shift to low if RPM<2500 and MVS is between 80 and 99

The electronic controller 36 inputs the RPM signal in line 38 and the manifold vacuum signal in line 40 from the engine 12. The RPM signal is preferably obtained from an electronic ignition system for the engine 12, however other devices can be used to measure the revolution rate of the engine 12. In a diesel engine, the engine revolution rate is typically measured by an RPM sensor having a magnetic pick-up. The shift parameter matrix in Table 1 preferably uses the actual revolution rate of the engine 12 in RPM. The manifold vacuum signal on line 40 is preferably generated by an intake manifold air pressure sensor such as a pressure transducer that is in fluid communication with the engine intake manifold. The manifold vacuum signal in line 40 inputs the electronic controller 36 as a 0 to 5 volt signal and is converted to a numeric scale from 1 to 99 for the purposes of the shift parameter matrix in Table 1. The shift parameter matrix in Table 1 is stored in memory within the electronic controller 36. If the values of the RPM signal in line 38 and the manifold vacuum signal in line 40 match the values in the shift parameter matrix in Table 1, the electronic controller 36 will generate a control signal in line 34 to shift the automatic transmission 16.

Parameters 1–7 in the shift parameter matrix of Table 1 are preferably chosen to enhance performance, acceleration and overall driveability. Parameters 1–5 are for shifting from low to high gear during acceleration. If the throttle to the engine 12 is applied slowly, the transmission 16 shifts from low to high gear at a lower engine revolution rate than if the throttle to the engine 12 were applied quickly. Parameter 6 is for shifting from high gear to low gear during deceleration. That is, as the engine revolution rate and load decrease to low speed operation or to a stop, the transmission 16 shifts from high gear to low gear. Parameter 7 in Table 1 can be referred to as a passing mode in which the transmission 16 will shift from high gear to low gear giving quick acceleration even at high engine loads if the engine revolution rate is not too high. After a passing shift to low gear has been accomplished, the electronic controller 36 would use shift parameters 1–5 to shift back into high gear.

While the preferred embodiment of the invention has been shown in connection with an inboard/outboard marine propulsion system 10, it should be noted that the multi-speed automatic shifting mechanism described herein is not limited to use on inboard/outboard systems. Such an automatic multi-speed shifting mechanism can readily be adapted to inboard marine propulsion systems or outboard propulsion systems. As stated above, the invention is also not limited to systems in which the automatic multi-speed shifting mechanism is a multi-speed transmission. Nor is the invention limited to systems having dual counterrotating propellers.

It should be recognized that various equivalents, alternatives and modifications are possible and should be considered to be within the scope of the appended claims.

We claim:

1. A marine propulsion system comprising:

an engine that provides power through a crankshaft rotating at an engine revolution rate;

a shifting mechanism, having at least a high gear and a lower gear, that inputs power from the engine crankshaft and outputs power to drive at least one propeller to propel a boat;

an electronic controller that inputs an RPM signal that is proportional to the engine revolution rate and an engine load signal that gives an indication of engine load, and outputs a control signal to control shifting of the shifting mechanism;

wherein said controller causes the shifting mechanism to shifts to high gear before the onset of propeller cavitation.

2. A marine propulsion system as recited in claim 1 wherein the electronic controller has a shift parameter matrix, and the control signal is generated in response to the RPM signal and the one or more engine load signals in accordance with the shift parameter matrix.

3. A marine propulsion system as recited in claim 1 wherein the electronic controller generates the control signal to shift the shifting mechanism to the low gear when the engine revolution rate is low.

4. A marine propulsion system as recited in claim 1 wherein the RPM signal is generated from an electronic ignition system for the engine.

5. A marine propulsion system as recited in claim 1 wherein the engine load signal is a manifold vacuum signal that is proportional to an air pressure in a manifold in the engine.

6. A marine propulsion system as recited in claim 1 wherein the engine load signal is a throttle position signal that is proportional to a position of a throttle for the engine.

7. A marine propulsion system as recited in claim 1 wherein the shifting mechanism outputs power to drive at least two counterrotating propellers.

8. A marine propulsion system as recited in claim 1 further comprising a manual override switch that can override the control signal from the electronic controller to control shifting of the shifting mechanism.

9. A marine propulsion system as recited in claim 1 wherein the lower gear in the shifting mechanism has a gear ratio of approximately 1.33:1 and the high gear in the shifting mechanism has a gear ratio of approximately 1:1.

10. A marine propulsion system comprising:

an engine that provides power through a crankshaft rotating at an engine revolution rate;

a drive unit that receives power through an input drive shaft and transmits the power to at least one propeller that propels a boat;

a transmission, having at least a high gear and a low gear, that receives power from the engine crankshaft and outputs power to the drive unit input shaft; and an electronic controller that receives an RPM signal that is proportional to the engine revolution rate and receives an engine load signal that gives an indication of engine load, and outputs a control signal to control shifting of the transmission, wherein the control signal is generated at least in part in response to the RPM signal and the engine load signal;

wherein said controller causes the shifting mechanism to shift to high gear before the onset of propeller cavitation.

11. A marine propulsion system as recited in claim 10 wherein the electronic controller has a shift parameter matrix and the control signal is generated in response to the RPM signal and the one or more engine load signals in accordance with the shift parameter matrix.

12. A marine propulsion system as recited in claim 10 wherein the drive unit is a stern drive unit having a forward gear, a neutral gear, and a reverse gear.

13. A marine propulsion system as recited in claim 12 wherein the low gear in the transmission has a gear ratio of approximately 4:3 and the high gear in the transmission has a gear ratio of approximately 1:1.

14. A marine propulsion system as recited in claim 10 wherein the transmission can be shifted into forward, neutral and reverse.

15. A marine propulsion system as recited in claim 10 wherein the engine load signal is an manifold vacuum signal that is proportional to an air pressure in a manifold in the engine.

16. A marine propulsion system as recited in claim 10 wherein the drive unit transmits power to at least two counterrotating propellers that propel the boat.

* * * * *

UNITED STATES PATENT AND TRADEMARK OFFICE

CERTIFICATE OF CORRECTION

PATENT NO. : 5,711,742

DATED : January 27, 1998

INVENTOR(S) : BRIAN M. LEINONEN ET AL.

It is certified that error appears in the above-indentified patent and that said Letters Patent is hereby corrected as shown below:

Claim 1, Col. 5, Line 2, delete "shifts" and substitute therefor ---to shift---

Signed and Sealed this

Seventh Day of July, 1998

Bruce Lehman

*Attest:*

BRUCE LEHMAN

*Attesting Officer*

*Commissioner of Patents and Trademarks*